US011974670B2

(12) United States Patent
Zhang

(10) Patent No.: US 11,974,670 B2
(45) Date of Patent: May 7, 2024

(54) ANTI-BOTTOM-FALLING SWIVEL GLIDE

(71) Applicant: Ningbo Hyderon Hardware Co., Ltd., Zhejiang (CN)

(72) Inventor: Lifeng Zhang, Zhejiang (CN)

(73) Assignee: Ningbo Hyderon Hardware Co., Ltd. (CN)

( * ) Notice: Subject to any disclaimer, the term of this patent is extended or adjusted under 35 U.S.C. 154(b) by 93 days.

(21) Appl. No.: 17/838,237

(22) Filed: Jun. 12, 2022

(65) Prior Publication Data

US 2023/0397725 A1 Dec. 14, 2023

(51) Int. Cl.
*A47B 91/06* (2006.01)

(52) U.S. Cl.
CPC ..... *A47B 91/066* (2013.01)

(58) Field of Classification Search
CPC ..... A47B 91/066; A47B 91/02; A47B 91/022; A47B 91/024; A47B 91/026; A47B 91/028; A47B 91/04; A47B 91/06; A47B 2091/063
USPC ..... 16/42 R, 42 T; 248/188.9, 188.3, 188.4
See application file for complete search history.

(56) References Cited

U.S. PATENT DOCUMENTS 827,806 A * 8/1906 Little ..... A47B 91/06 16/42 R
1,559,699 A * 11/1925 Herold ..... A47B 91/06 16/38
2,954,636 A * 10/1960 Gammache ..... A47C 7/002 16/42 T
3,006,673 A * 10/1961 Swick ..... A47B 91/066 248/188.8
3,366,991 A * 2/1968 Le Vasseur ..... A47B 91/066 16/42 R
5,242,141 A * 9/1993 Chester ..... A47B 91/00 248/188.9
6,910,666 B2 * 6/2005 Burr ..... F16M 7/00 248/188.4
8,015,663 B2 * 9/2011 Vorpahl ..... A47B 91/066 248/346.11
8,607,413 B2 * 12/2013 Carpinella ..... A47B 91/066 16/42 T
10,125,913 B2 * 11/2018 Ramsauer ..... F16C 11/0609
2005/0172449 A1 * 8/2005 Carpinella ..... A47B 91/06 16/42 R
2009/0025184 A1 * 1/2009 Clarke ..... A47B 91/066 16/42 T
2019/0387881 A1 * 12/2019 Lin ..... F16B 43/02
(Continued)

*Primary Examiner* — Jeffrey O'Brien

(57) ABSTRACT

An swivel glide includes a metal screw stem, a hemispherical plastic connecting seat and a hemispherical plastic base; the lower end of the metal screw stem is connected to the top of the hemispherical plastic connecting seat; the hemispherical plastic connecting seat is formed by injection molding of plastic parts, wherein the bottom of the hemispherical plastic connecting seat is provided with a cavity, a side wall of the cavity is provided with a concave arc-shaped spherical surface, wherein an outer side wall of the hemispherical plastic base is provided with a convex arc-shaped spherical surface, wherein a convex arc-shaped spherical surface is clamped in the concave arc-shaped spherical surface, and diameter of the concave arc-shaped spherical surface is 1 mm larger than diameter of the convex arc-shaped spherical surface.

4 Claims, 4 Drawing Sheets

(56) References Cited

U.S. PATENT DOCUMENTS

2023/0255353 A1* 8/2023 Hui ..... B29C 45/04
16/42 R

* cited by examiner

ANTI-BOTTOM-FALLING SWIVEL GLIDE

TECHNICAL FIELD

The present disclosure relates to the field of swivel glides, in particular to an anti-bottom-falling swivel glide.

BACKGROUND

Swivel gliders are installed on the parts where the soles of table legs, chair legs, and light display racks are in contact with the ground. Presently, there are two kinds of products on the market. The first kind is produced by stamping and riveting together with metal parts, metal ball heads and plastic parts. The production process consists of numerous parts and sub-processes. The process is complicated and difficult. Quality control during the process is also difficult. The second kind is produced by directly pressing metal ball heads into a plastic bottom to serve a universal role. The structure is simple, however, the diameter of the metal ball head is generally between 9-12 mm, the metal ball head can be separated easily from the plastic bottom when being dragged and lead the plastic bottom to fall off. For this reason, an anti-bottom-falling swivel glide is introduced.

SUMMARY

The purpose of the present disclosure is to provide an anti-bottom-falling swivel glide to solve the problems mentioned in the above background art.

In order to solve the above problems, the present disclosure provides the following technical solution. An anti-bottom-falling swivel glide comprises a metal screw stem, a hemispherical plastic connecting seat and a hemispherical plastic base, wherein the lower end of the metal screw stem is connected to the top of the hemispherical plastic connecting seat;

the hemispherical plastic connecting seat is formed by injection molding of plastic parts, the bottom of the hemispherical plastic connecting seat is provided with a cavity in the center, the side wall of the cavity is provided with a concave arc-shaped spherical surface, the outer side wall of the hemispherical plastic base is provided with a convex arc-shaped spherical surface, the convex arc-shaped spherical surface is clamped in the concave arc-shaped spherical surface, and the diameter of the concave arc-shaped spherical surface is 1 mm larger than that of the convex arc-shaped spherical surface;

the top of the concave arc-shaped spherical surface is provided with a concave central arc-shaped spherical surface in the center, the top of the convex arc-shaped spherical surface is provided with a convex central arc-shaped spherical surface in the center, and the convex central arc-shaped spherical surface is clamped in the concave central arc-shaped spherical surface;

a circle between the concave arc-shaped spherical surface and the central concave central arc-shaped spherical surface is provided with an inclined platform with an upward tilt angle of +/−22 degrees, and a circle between the convex arc-shaped spherical surface and the convex central arc-shaped spherical surface is provided with a horizontal platform.

The hemispherical plastic base is formed by injection molding of plastic parts. During assembly, the hemispherical plastic base is pressed into the cavity at the bottom of the hemispherical plastic connecting seat.

Compared with the prior art, the present disclosure has the following advantages. The inner wall of the hemispherical plastic connecting seat and the outer wall of the hemispherical plastic base are both arc-shaped spherical structures (i.e., the side wall of the cavity is provided with an concave arc-shaped spherical surface, and the outer side wall of the hemispherical plastic base is provided with a convex arc-shaped spherical surface), and the inner diameter of the caliber of the hemispherical plastic connecting seat is smaller than the maximum size of the inner diameter of the cavity ≤1 mm (i.e., the diameter of the concave arc-shaped spherical surface is 1 mm larger than that of the convex arc-shaped spherical surface), which realizes the function of universal rotation and is not easy to fall off under the mutual cooperation.

Because the top of the concave arc-shaped spherical surface is provided with a concave central arc-shaped spherical surface in the center, and the top of the convex arc-shaped spherical surface is provided with a convex central arc-shaped spherical surface in the center, the convex central arc-shaped spherical surface is clamped in the concave central arc-shaped spherical surface. The convex central arc-shaped spherical surface and the concave central arc-shaped spherical surface cooperate with each other to support the weight of the object.

The present disclosure consists of two plastic products (i.e., a hemispherical plastic connecting seat and a hemispherical plastic base), which have few parts and simple production and manufacture. In the design, the product connection structure in which double arc-shaped spherical surfaces cooperate with each other (i.e., the convex central arc-shaped spherical surface and the concave central arc-shaped spherical surface cooperate with each other, and the convex arc-shaped spherical surface and the concave arc-shaped spherical surface cooperate with each other) is used, which solves the phenomenon that two plastic parts are separated and the bottom thereof fall off when being dragged in use.

Because a circle between the concave arc-shaped spherical surface and the concave central arc-shaped spherical surface is provided with an inclined platform with an upward tilt angle of +/−22 degrees, and a circle between the convex arc-shaped spherical surface and the convex central arc-shaped spherical surface is provided with a horizontal platform, after the hemispherical plastic base is pressed into the cavity at the bottom of the hemispherical plastic connecting seat, the inclined platform contacts and connects with the horizontal platform during the universal angle adjustment movement, so that the hemispherical plastic connecting seat is always kept within the adjustment range of +/−22 degrees. The anti-bottom-falling swivel glide is suitable for most use environments, such as table legs, chair legs, and light display racks, that is, the anti-bottom-falling swivel glide is suitable for use in tables and chair legs with different angles. The anti-bottom-falling swivel glide can keep level with the ground on rugged ground, increase the contact surface, and place the light display rack more stably.

In the figures: 1. Metal screw stem; 2. Stepped seat; 3. Hemispherical plastic connecting seat; 4. Concave arc-shaped spherical surface; 5. Concave central arc-shaped spherical surface; 6. Hemispherical plastic base; 7. Convex arc-shaped spherical surface; 8. Convex central arc-shaped spherical surface; 9. Cavity; 10. Horizontal plane; 11. Horizontal platform; 12. Inclined platform.

DETAILED DESCRIPTION OF THE EMBODIMENTS

The technical solutions in the embodiments of the present disclosure will be clearly and completely described hereinafter with reference to the drawings in the embodiments of the present disclosure. Obviously, the described embodiments are merely part of the embodiments of the present disclosure, rather than all of the embodiments. Based on the embodiment of the present disclosure, all other embodiments obtained by those skilled in the art without creative labor fall within the scope of the present disclosure.

Figure 1:
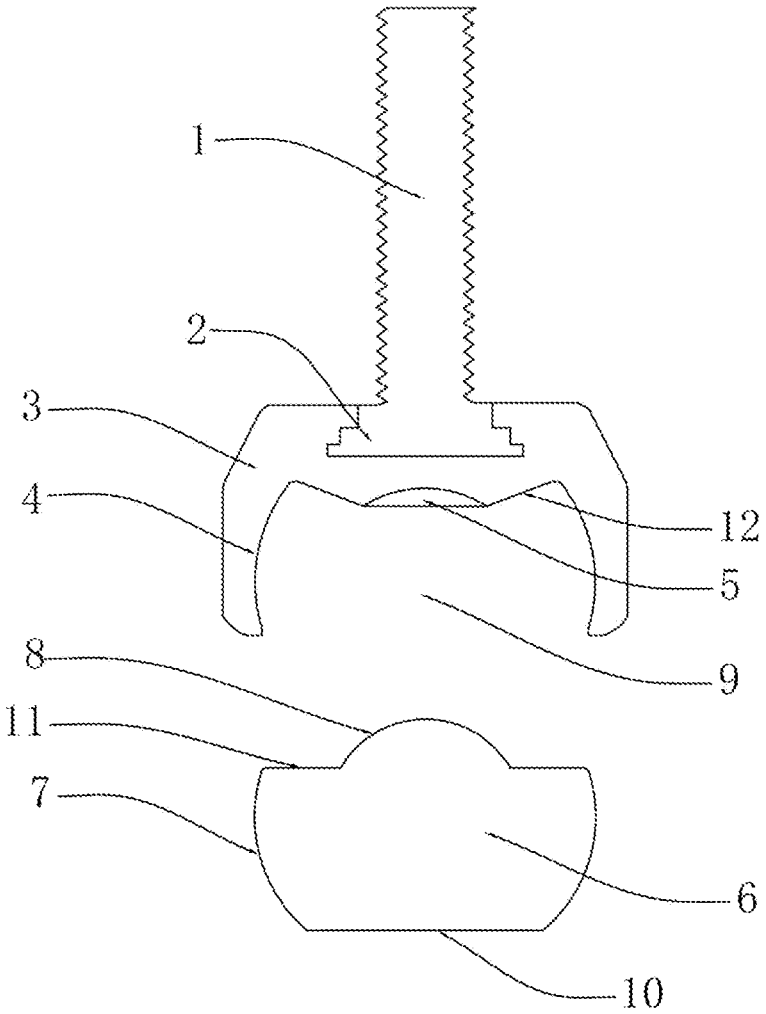
FIG. 1 is an exploded structural diagram of the installation of a hemispherical plastic base and a hemispherical plastic connecting seat according to the present disclosure.
Figure 2:
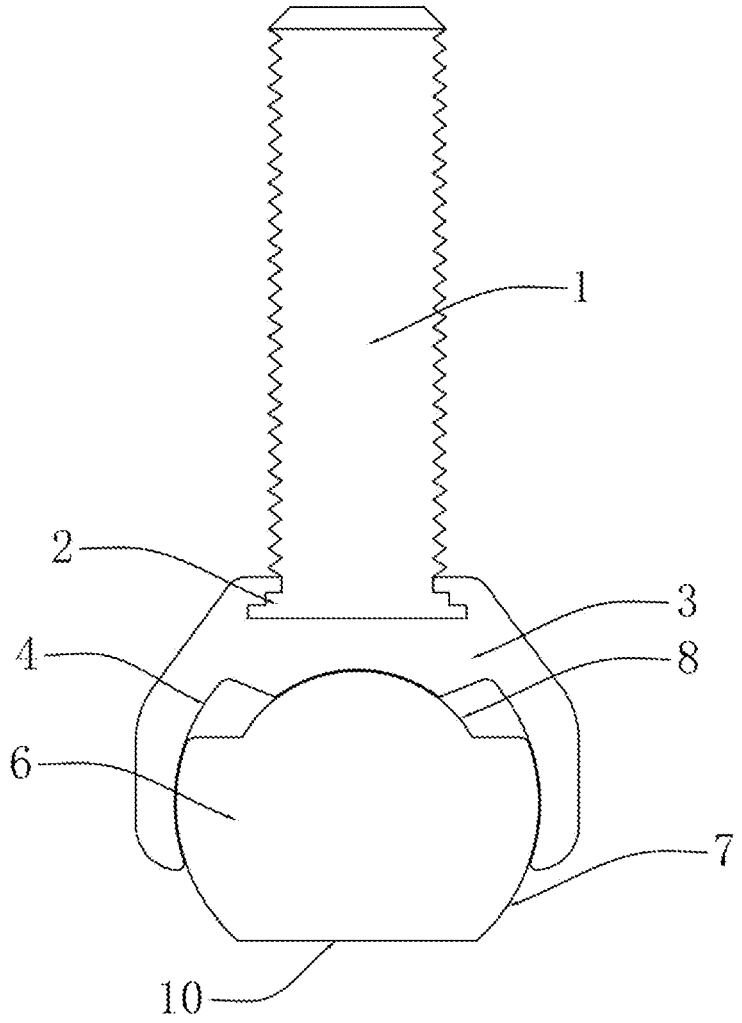
FIG. 2 is a schematic diagram of a side cross-sectional structure after the present disclosure is installed integrally.
Figure 3:
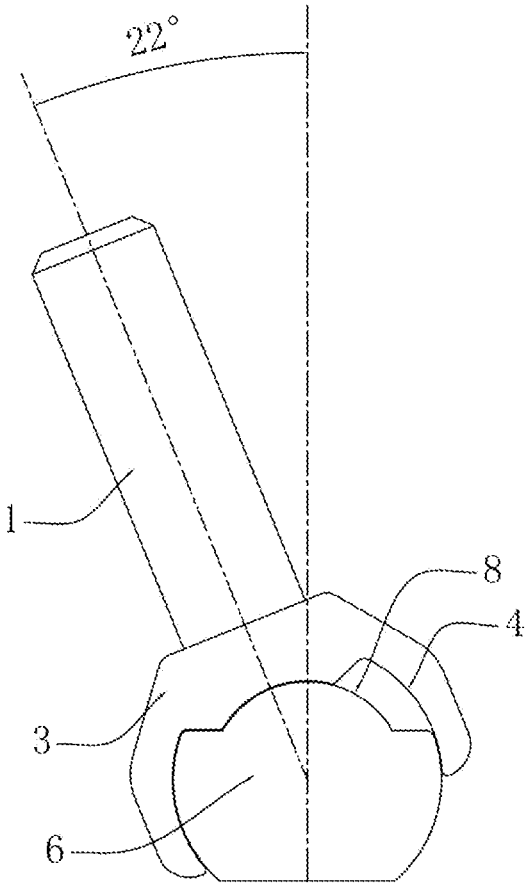
FIG. 3 is a schematic diagram of a side cross-sectional structure of a metal screw stem and a hemispherical plastic connecting seat according to the present disclosure after the angle is adjusted as a whole.
Figure 4:
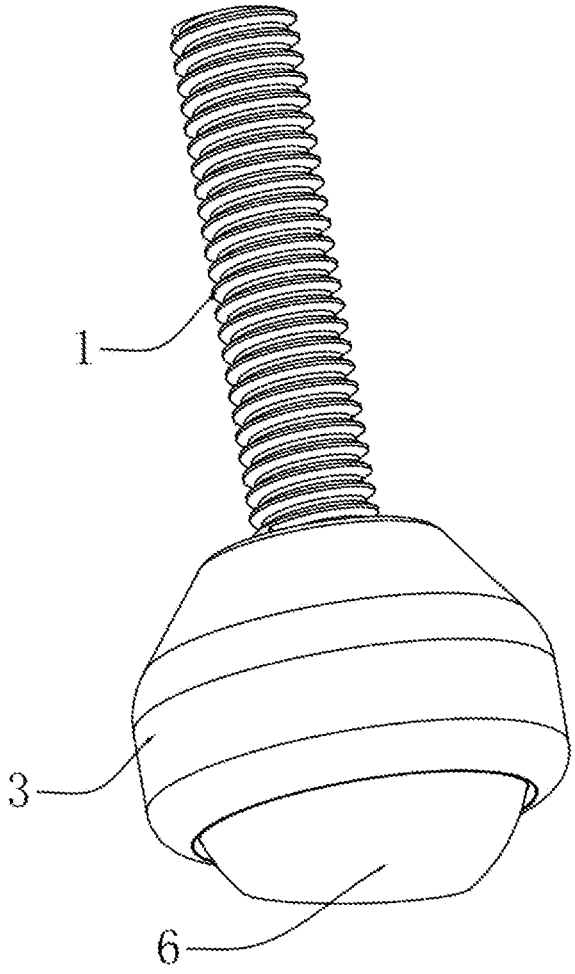
FIG. 4 is a schematic diagram of the overall three-dimensional structure of the present disclosure.

Referring to FIGS. 1-4, the present disclosure provides a technical solution. An anti-bottom-falling swivel glide comprises a metal screw stem 1, a hemispherical plastic connecting seat 3 and a hemispherical plastic base 6. The lower end of the metal screw stem 1 is connected to the top of the hemispherical plastic connecting seat 3. The lower end of the metal screw stem 1 is connected with a stepped seat 2 integrally formed therewith, and the stepped seat 2 is connected to the top of the hemispherical plastic connecting seat 3. The stepped seat 2 is injection molded in a pre-embedded manner.

The hemispherical plastic connecting seat 3 is formed by injection molding of plastic parts. The bottom of the hemispherical plastic connecting seat 3 is provided with a cavity 9 in the center. The side wall of the cavity 9 is provided with a concave arc-shaped spherical surface 4. The outer side wall of the hemispherical plastic base 6 is provided with a convex arc-shaped spherical surface 7. The convex arc-shaped spherical surface 7 is clamped in the concave arc-shaped spherical surface 4, and the diameter of the concave arc-shaped spherical surface 4 is 1 mm larger than that of the convex arc-shaped spherical surface 7.

The top of the concave arc-shaped spherical surface 4 is provided with a concave central arc-shaped spherical surface 5 in the center. The top of the convex arc-shaped spherical surface 7 is provided with a convex central arc-shaped spherical surface 8 in the center. The convex central arc-shaped spherical surface 8 is clamped in the concave central arc-shaped spherical surface 5.

A circle between the concave arc-shaped spherical surface 4 and the concave central arc-shaped spherical surface 5 is provided with an inclined platform 12 with an upward tilt angle of +/−22 degrees, and a circle between the convex arc-shaped spherical surface 7 and the convex central arc-shaped spherical surface 8 is provided with a horizontal platform 11.

The middle of the lower end of the hemispherical plastic base 6 is provided with a horizontal plane 10 supported on the ground. The horizontal plane 10 is provided, which is convenient for the hemispherical plastic base 6 to be supported on the horizontal ground. The hemispherical plastic base can keep level with the ground on rugged ground, increase the contact surface, and place tables, chairs or light display racks more stably.

Specifically, when in use, the hemispherical plastic base 6 is formed by injection molding of plastic parts. During assembly, the hemispherical plastic base 6 is pressed into the cavity 9 at the bottom of the hemispherical plastic connecting seat 3.

The inner wall of the hemispherical plastic connecting seat 3 and the outer wall of the hemispherical plastic base 6 are both arc-shaped spherical structures (i.e., the side wall of the cavity 9 is provided with an concave arc-shaped spherical surface 4, and the outer side wall of the hemispherical plastic base 6 is provided with a convex arc-shaped spherical surface 7), and the inner diameter of the caliber of the hemispherical plastic connecting seat 3 is smaller than the maximum size of the inner diameter of the cavity ≤1 mm (i.e., the diameter of the concave arc-shaped spherical surface 4 is 1 mm larger than that of the convex arc-shaped spherical surface 7), which realizes the function of universal rotation and is not easy to fall off under the mutual cooperation.

Because the top of the concave arc-shaped spherical surface 4 is provided with a concave central arc-shaped spherical surface 5 in the center, and the top of the convex arc-shaped spherical surface 7 is provided with a convex central arc-shaped spherical surface 8 in the center, the convex central arc-shaped spherical surface 8 is clamped in the concave central arc-shaped spherical surface 5. The convex central arc-shaped spherical surface 8 and the concave central arc-shaped spherical surface 5 cooperate with each other to support the weight of the object.

Because a circle between the concave arc-shaped spherical surface 4 and the concave central arc-shaped spherical surface 5 is provided with an inclined platform 12 with an upward tilt angle of +/−22 degrees, and a circle between the convex arc-shaped spherical surface 7 and the convex central arc-shaped spherical surface 8 is provided with a horizontal platform 11, after the hemispherical plastic base 6 is pressed into the cavity 9 at the bottom of the hemispherical plastic connecting seat 3, the inclined platform 12 contacts and locates with the horizontal platform 11 during the universal angle adjustment movement, so that the hemispherical plastic connecting seat 3 is always kept within the adjustment range of +/−22 degrees.

Although the embodiments of the present disclosure have been shown and described, it will be understood by those skilled in the art that many changes, modifications, substitutions and variations can be made to these embodiments without departing from the principle and spirit of the present disclosure, and the scope of the present disclosure is defined by the appended claims and their equivalents.

The invention claimed is:

1. A swivel glide, comprising a metal screw stem (1), a hemispherical plastic connecting seat (3) and a hemispherical plastic base (6), wherein a lower end of the metal screw stem (1) is connected to a top of the hemispherical plastic connecting seat (3);

wherein the hemispherical plastic connecting seat (3) is formed by injection molding of plastic parts, wherein a bottom of the hemispherical plastic connecting seat (3) is provided with a cavity (9), wherein a side wall of the cavity (9) is provided with a concave arc-shaped spherical surface (4), wherein an outer side wall of the hemispherical plastic base (6) is provided with a convex arc-shaped spherical surface (7), wherein the convex arc-shaped spherical surface (7) is clamped in the concave arc-shaped spherical surface (4), and wherein a diameter of the concave arc-shaped spherical surface (4) is 1 mm larger than a diameter of the convex arc-shaped spherical surface (7);

wherein a top of the concave arc-shaped spherical surface (4) is provided with a concave central arc-shaped spherical surface (5) in the center, wherein a top of the convex arc-shaped spherical surface (7) is provided with a convex central arc-shaped spherical surface (8) in the center, and wherein the convex central arc-shaped spherical surface (8) is clamped in the concave central arc-shaped spherical surface (5);

wherein a circle between the concave arc-shaped spherical surface (4) and the concave central arc-shaped spherical surface (5) is provided with an inclined platform (12) with an upward tilt angle of +/−22 degrees, and wherein a circle between the convex arc-shaped spherical surface (7) and the convex central arc-shaped spherical surface (8) is provided with a horizontal platform (11).

2. The swivel glide according to claim 1, wherein the lower end of the metal screw stem (1) is connected with a stepped seat (2) integrally formed therewith, wherein the stepped seat (2) is connected to the top of the hemispherical plastic connecting seat (3), and wherein the stepped seat (2) is injection molded.

3. The swivel glide according to claim 1, wherein after the hemispherical plastic base (6) is pressed into the cavity (9) at the bottom of the hemispherical plastic connecting seat (3), the inclined platform (12) contacts and connects with the horizontal platform (11) during an universal angle adjustment movement, so that the hemispherical plastic connecting seat (3) is always kept within an adjustment range of +/−22 degrees.

4. The swivel glide according to claim 1, wherein a middle of a lower end of the hemispherical plastic base (6) is provided with a horizontal plane (10) supported on a ground surface.

* * * * *